US011207723B2

(12) United States Patent
Martinello et al.

(10) Patent No.: US 11,207,723 B2
(45) Date of Patent: Dec. 28, 2021

(54) STRAIGHTENING APPARATUS FOR METAL PRODUCTS AND METHOD TO REPLACE AT LEAST ONE STRAIGHTENING ROLL OF SAID APPARATUS

(71) Applicant: DANIELI & C. OFFICINE MECCANICHE S.P.A., Buttrio (IT)

(72) Inventors: Paolo Martinello, Staranzano (IT); Simone Tibalt, Flaibano (IT); Alessandro Rossit, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 382 days.

(21) Appl. No.: 16/220,342

(22) Filed: Dec. 14, 2018

(65) Prior Publication Data

US 2019/0184439 A1 Jun. 20, 2019

(30) Foreign Application Priority Data

Dec. 15, 2017 (IT) ..... 102017000145291

(51) Int. Cl.

| | |
|---|---|
| ***B21D 1/02*** | (2006.01) |
| ***B21D 37/14*** | (2006.01) |
| ***B21D 3/02*** | (2006.01) |
| ***B21B 15/00*** | (2006.01) |
| ***B21D 1/05*** | (2006.01) |

(52) U.S. Cl.

CPC ..... *B21D 1/02* (2013.01); *B21D 3/02* (2013.01); *B21D 37/14* (2013.01); *B21B 2015/0071* (2013.01); *B21D 1/05* (2013.01)

(58) Field of Classification Search

CPC . B21D 37/04; B21D 1/02; B21D 3/02; B21D 3/04; B21B 31/00; B21B 31/02; B21B 31/08; B21B 31/10; B21B 31/103; B21B 2015/0071; Y10T 403/66

USPC ..... 72/238, 239

See application file for complete search history.

(56) References Cited

U.S. PATENT DOCUMENTS 5,273,626 A * 12/1993 Niskanen ..... D21G 1/022 100/162 B
5,600,988 A * 2/1997 Abbey, III ..... B21B 31/103 72/176
2005/0056068 A1* 3/2005 Hartung ..... B21D 3/05 72/164

(Continued)

FOREIGN PATENT DOCUMENTS

CN 111372697 A * 7/2020 ..... B21B 31/02
FR 2895689 A1 * 7/2007 ..... B21B 31/103

*Primary Examiner* — Edward T Tolan
*Assistant Examiner* — Katie L. Parr
(74) *Attorney, Agent, or Firm* — Hamre, Schumann, Mueller & Larson, P.C.

(57) ABSTRACT

Apparatus for straightening metal products comprising:
at least one rotation shaft on which at least one straightening roll is installed in a selectively removable manner;
a first structure provided with at least a first support member configured to hold and support a first end of the rotation shaft;
a second structure provided with at least a second support member configured to selectively support and hold a second end, opposite the first end, of the rotation shaft;
a movement member configured to move the second structure toward/away from the first structure and to allow the installation or removal of the straightening roll from the rotation shaft.

9 Claims, 5 Drawing Sheets

(56) References Cited

U.S. PATENT DOCUMENTS

2016/0016214 A1* 1/2016 Nespoli ..... B21D 37/147
72/239

* cited by examiner

STRAIGHTENING APPARATUS FOR METAL PRODUCTS AND METHOD TO REPLACE AT LEAST ONE STRAIGHTENING ROLL OF SAID APPARATUS

FIELD OF THE INVENTION

The present invention concerns a straightening apparatus used to straighten oblong metal products such as beams, sheet piles, rails, C-shaped irons, mine arches, T-shaped, double T-shaped, tubular or similar profiles.

The straightening apparatus comprises at least one straightening roll installed, removably, on a rotation shaft.

The present invention also concerns a method to replace the at least one straightening roll of the straightening apparatus.

BACKGROUND OF THE INVENTION

Following rolling processes of a metal product and its cooling, it is known that, due to the residual stresses that occur during cooling, the metal product is subjected to deformations or deviations of its profile which can cause geometric modifications along its longitudinal extension and/or its cross-section.

In order to cope with this disadvantage, the metal product exiting from the rolling line is made to pass through a straightening apparatus suitable to straighten the metal product and make it comply with certain dimensional parameters.

By straightening we mean the joint action of a series of straightening rolls or disks, normally staggered and on different planes, which induce a yield of the metal to obtain a section bar with the desired sizes and geometry.

It is known, in fact, that straightening apparatuses usually comprise a plurality of rotation shafts each of which supports a respective straightening roll.

It is also provided that a first group of rotation shafts is installed in such a way that its rotation shafts all lie on a first common lying plane, and that a second group of rotation shafts is installed in such a way that its rotation shafts all lie on a second common lying plane which is parallel to the first lying plane.

Moreover, along the straightening path of the metal product, the rotation shafts of the first group are staggered with respect to the rotation shafts of the second group.

Moreover, the rotation shafts are supported at the ends by a support structure, usually fixed, also called fixed shoulder, and in operation by a support structure, usually mobile, also called mobile shoulder.

The mobile shoulder can be moved toward/away from the fixed shoulder to allow the replacement of the straightening rolls installed on the rotation shafts, keeping the support shafts integral with the fixed shoulder.

A first known solution to replace the straightening rolls provides, in fact, to position the straightening rolls in advance on a mobile store, also called rack. When the mobile shoulder is moved away from the fixed shoulder, the mobile store with the straightening rolls is taken into the space comprised between the mobile shoulder and the fixed shoulder. Subsequently, the mobile shoulder, together with the mobile store, is moved toward the fixed shoulder to allow the insertion of the straightening rolls on the respective rotation shafts. Holding members, associated with the mobile shoulder, constrain the position of the straightening rolls on the rotation shafts. The mobile store, during straightening, remains in position between the two support shoulders of the shafts.

This solution, besides making the operations to install/remove the straightening rolls extremely complex, completely dirties the mobile store due to the oxidation of the metal product during the straightening, which generates scale.

Another solution is also known, in which the straightening rolls to be installed on the rotation shafts are positioned on mobile support frames on suspended structures, such as bridge cranes.

Using the bridge cranes it is possible to take the support frames and the straightening rolls into the space comprised between the fixed shoulder and the mobile shoulder, and install the straightening rolls on the rotation shafts.

The support frames are then moved, using the bridge cranes, to position themselves in a position that does not interfere with the space between the shoulders.

This solution, although it prevents the support frames from getting dirtied, requires the installation of rather complex and bulky structures, at least in height, in correspondence with the straightening apparatus.

One purpose of the present invention is to provide a straightening apparatus for metal products which makes operations to replace the straightening rolls extremely simple and rapid.

Another purpose of the present invention is to provide a straightening apparatus which does not require complex support and movement structures of the straightening rolls.

Another purpose of the present invention is to provide a straightening apparatus which can be installed in buildings also of low height.

Another purpose of the present invention is to perfect a method to replace at least one straightening roll which is extremely simple and rapid.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus for straightening metal products, according to the present invention, comprises:

at least one rotation shaft on which at least one straightening roll is installed in a selectively removable manner;

a first structure provided with at least a first support member configured to hold and support a first end of the rotation shaft;

a second structure provided with at least a second support member configured to selectively support and hold a second end of the rotation shaft;

a movement member configured to move the second structure toward/away from the first structure and to allow the installation or removal of the straightening roll from the rotation shaft.

In accordance with one aspect of the present invention, the second structure is provided with gripping means, able to be selectively activated to take and hold the straightening roll on the second structure at least during the movement of the second structure.

This solution allows to simplify and drastically reduce the time needed to replace the straightening roll. Indeed, when it is necessary to replace the straightening roll, the gripping means are activated to take and hold the straightening roll integrally on the second structure. By moving the movement member, the second structure is moved away from the first structure and takes with it the straightening roll as well. The latter is therefore axially removed from the rotation shaft and stays supported on the second structure by means of the gripping means.

In this condition, it is possible to insert a support structure, provided in order to receive and discharge the straightening rolls.

Moreover, with the present invention, it is no longer necessary to use complex movement apparatuses of the straightening rolls that can be bulky and particularly costly. Indeed, the second structure itself acts as a support element for the straightening rolls, without requiring the use of dedicated structures.

Embodiments of the present invention also concern a method to replace a straightening roll, installed in a selectively removable manner, on a rotation shaft.

The method provides to hold and support a first end of the rotation shaft on a first support member of the first structure, and to selectively support and hold a second end of the rotation shaft on a second support member of a second structure.

The method also provides to move the second structure, with a movement member, toward/away from the first structure to generate a maneuvering space for the installation and/or removal of the straightening roll from the rotation shaft. In accordance with one aspect of the invention, relating to the method, at least during the movement of the second structure, toward/away from the first structure, gripping means take and hold the straightening roll on the second structure to allow, during the removal, the axial removal of the straightening roll from the rotation shaft or, during installation, the axial insertion of the straightening roll on the rotation shaft.

In accordance with a possible embodiment of the present invention, when the installation of the straightening roll on the rotation shaft is required:

a support slider with the at least one straightening roll is positioned between the first structure and the second structure, disposing the straightening roll facing the second structure, the gripping means take and hold the straightening roll, the support slider moves outside the space comprised between the first structure and the second structure, leaving the straightening roll on the second structure, and the second structure is moved toward the first structure to insert the straightening roll on the rotation shaft.

In accordance with another embodiment of the present invention, when the removal of the straightening roll from the rotation shaft is required:

the gripping means are driven to take and hold the straightening roll on the second structure, the second structure is moved away from the first structure, removing the straightening roll from the rotation shaft, a support slider is positioned between the first structure and the second structure to receive the straightening roll supported by the second structure, the gripping means are deactivated to position the straightening roll on the support slider.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
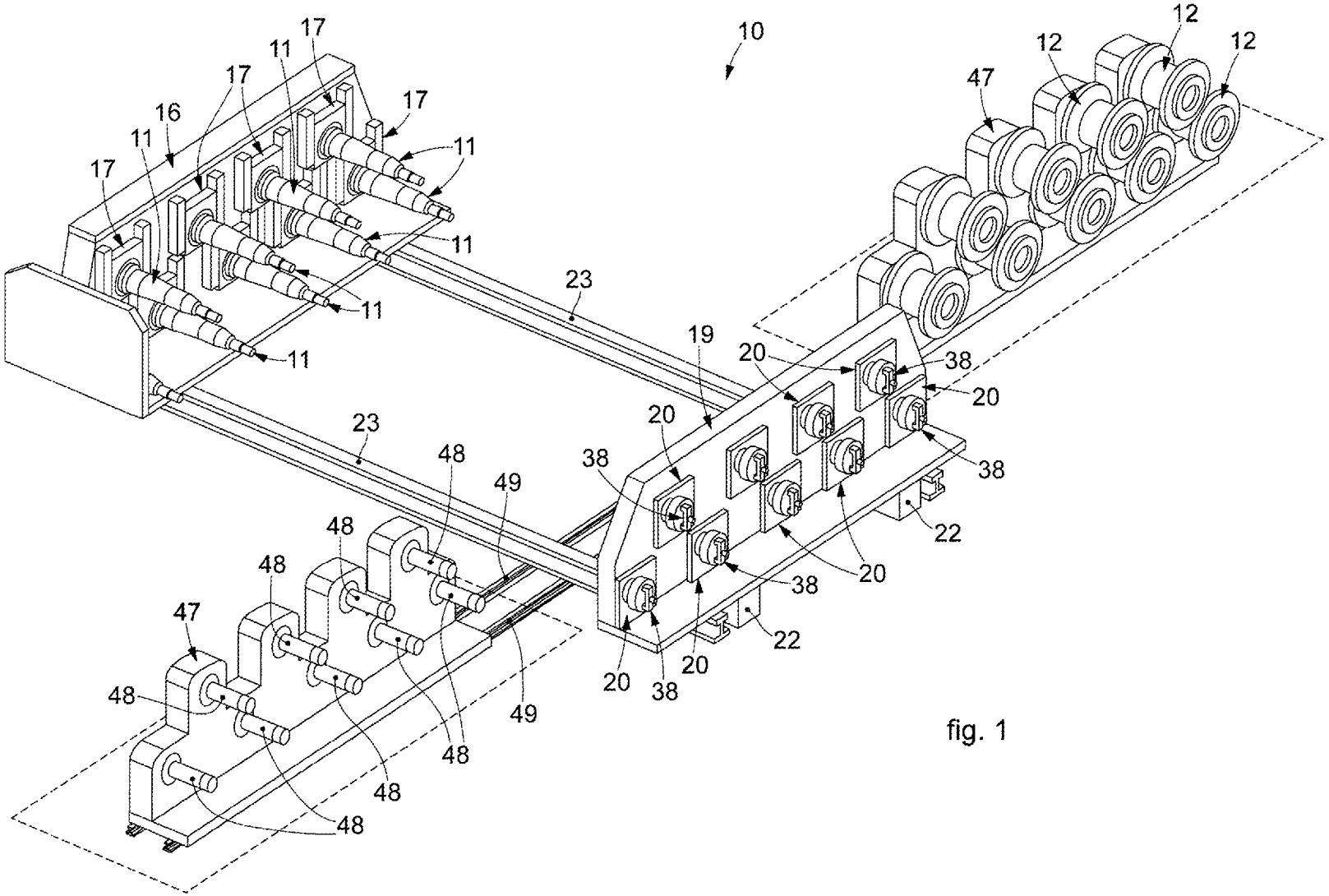
FIG. 1 is a schematic illustration of a straightening apparatus for a metal product in accordance with a possible embodiment of the present invention.

With reference to FIG. 1 a straightening apparatus for a metal product is indicated in its entirety by the reference number 10.

The straightening apparatus 10 comprises at least one rotation shaft 11, in this specific case a plurality of rotation shafts 11 on each of which at least one straightening roll 12, also referred to in this specific field as straightening disk, is installed in a selectively removable manner.

The rotation shaft 11 is selectively rotatable around a respective axis of rotation Z, and makes the straightening roll 12 rotate with it.

The straightening roll 12 is provided with a through axial cavity 36 in which the rotation shaft 11 is inserted axially.

For this purpose, between the straightening roll 12 and the rotation shaft 11 known interference elements are provided, not shown in the drawings, such as tongues, keys, plugs or suchlike, suitable to make the rotation of the rotation shaft 11 and the straightening roll 12 integral with each other.

In accordance with some solutions of the invention, the straightening roll 12 can comprise a tubular body, or bushing 13, provided with the axial cavity 36 which can be axially inserted on the rotation shaft 11, and two straightening rings 14 attached integrally to the ends of the bushing 13.

The straightening roll 12 can comprise, between the straightening rings 14, a spacer element 15 provided to keeping the straightening rings 14 distanced from each other.

The bushing 13 can be made from a set of components reciprocally connected to each other in predefined ways.

According to another aspect of the present invention, the straightening apparatus 10 comprises a first structure 16 provided with at least a first support member 17, in this specific case a plurality of first support members 17, each configured to hold and support a first end 18 of the rotation shaft 11.

According to a possible embodiment of the invention, the first structure 16 can be installed in a fixed position.

According to variant embodiments, the first structure 16 can be movable, for example in a direction parallel to the axis of rotation Z.

The straightening apparatus 10 also comprises a second structure 19 provided with at least a second support member 20, in this specific case a plurality of second support members 20 each configured to selectively support and hold a second end 21 of the rotation shaft 11.

According to possible solutions, the first end 18 can be opposite the second end 21, and between them, the straightening roll 12 is installed during use.

In the specific field of the invention, the first structure 16 and the second structure 19 are also called shoulders, while the first support member 17 and the second support member 20 are called chocks.

The second structure 19 is facing and distanced from the first structure 16 and, during use, the straightening roll 12 is installed between them.

According to another aspect of the present invention, the straightening apparatus 10 also comprises at least one movement member 22 (FIG. 1) configured to move the second structure 19 toward/away from the first structure 16 and to allow installation or removal of the straightening roll 12 on/from the rotation shaft 11.

The at least one movement member 22 can comprise a linear actuator, a rack mechanism, a worm screw mechanism, or similar or comparable members.

In accordance with some embodiments of the present invention, the straightening apparatus 10 can comprise guide elements 23 on which the second structure 19 is installed in a sliding and guided manner, by means of the movement member 22.

According to possible solutions, the guide elements 23 have their guide axes substantially parallel to the axes of rotation Z of the rotation shafts 11.

In accordance with some solutions of the present invention, the guide elements 23 have a length suitable to distance the second structure 19 from the first structure 16 by a distance at least greater than double the length of the straightening rolls 12. This allows to generate between the first structure 16 and the second structure 19 an interspace suitable to allow the operations to replace the straightening rolls 12.

According to one aspect of the present invention, the second structure 19 is provided with gripping means 24 (FIGS. 2-4, 6 and 7, 9-12) that can be selectively activated to take and hold the straightening roll 12 on the second structure 19 at least during the movement of the second structure 19.

In this way, by moving the second structure 19 away from the first structure 16, it is possible to axially remove the straightening rolls 12 from the respective rotating shafts 11, with the respective bushings 13, since the latter are axially displaced and supported by the second structure 19.

On the contrary, when the second structure 19 is moved toward the first structure 16, it is possible to insert the straightening rolls 12 with the respective bushings 13, supported by the second structure 19, on the respective rotation shafts 11.

The gripping means 24 are in fact configured to selectively constrain the position of the straightening roll 12 and the second structure 19, preventing their reciprocal movement in a direction parallel to the axis of rotation Z.

According to possible solutions of the present invention, the second structure 19 is provided with a first surface 25 facing, during use, toward the first structure 16, and a second surface 26, opposite the first surface 25, facing toward the outside during use.

According to a possible embodiment, the gripping means 24 are installed, at least partly, in the space comprised between the first surface 25 and the straightening roll 12, in order to act directly on the latter.

In accordance with a possible solution, the gripping means 24 can comprise at least one gripping element 27 configured to attach at least one portion of the straightening roll 12, and an actuation device 28 configured to take the gripping element 27 into an active condition of attachment of the straightening roll 12 and into an inactive condition of non-interference with the straightening roll 12.

In accordance with some solutions of the invention, in its inactive condition, the gripping element 27 is positioned above and in a non-interfering condition with the rotation of the rotation shaft 11 and, in its active condition, it is in an interfering condition with the movement of the straightening roll 12.

This solution allows to position the gripping element 27 directly in the interspace 32 which is created between the first surface 25 of the second structure 19 and the straightening roll 12.

In accordance with some solutions, the actuation device 28 is configured to move the at least one gripping element 27 linearly in an incident direction toward the straightening roll 12 in order to take the gripping element 27 into the active and inactive condition.

According to variant embodiments, not shown, the actuation device is configured to rotate the gripping element around an axis of rotation and take it into its active and inactive condition.

The axis of rotation of the gripping element can be substantially parallel to the axis of rotation Z of the rotation shaft 11.

According to possible solutions, the straightening roll 12 is provided, at one of its ends, with a gripping edge 31.

The gripping edge 31, during use, directly faces the second structure 19, so that the gripping means 24 can be selectively coupled with the gripping edge 31 to take and hold the straightening roll 12 on the second structure 19.

Figure 2:
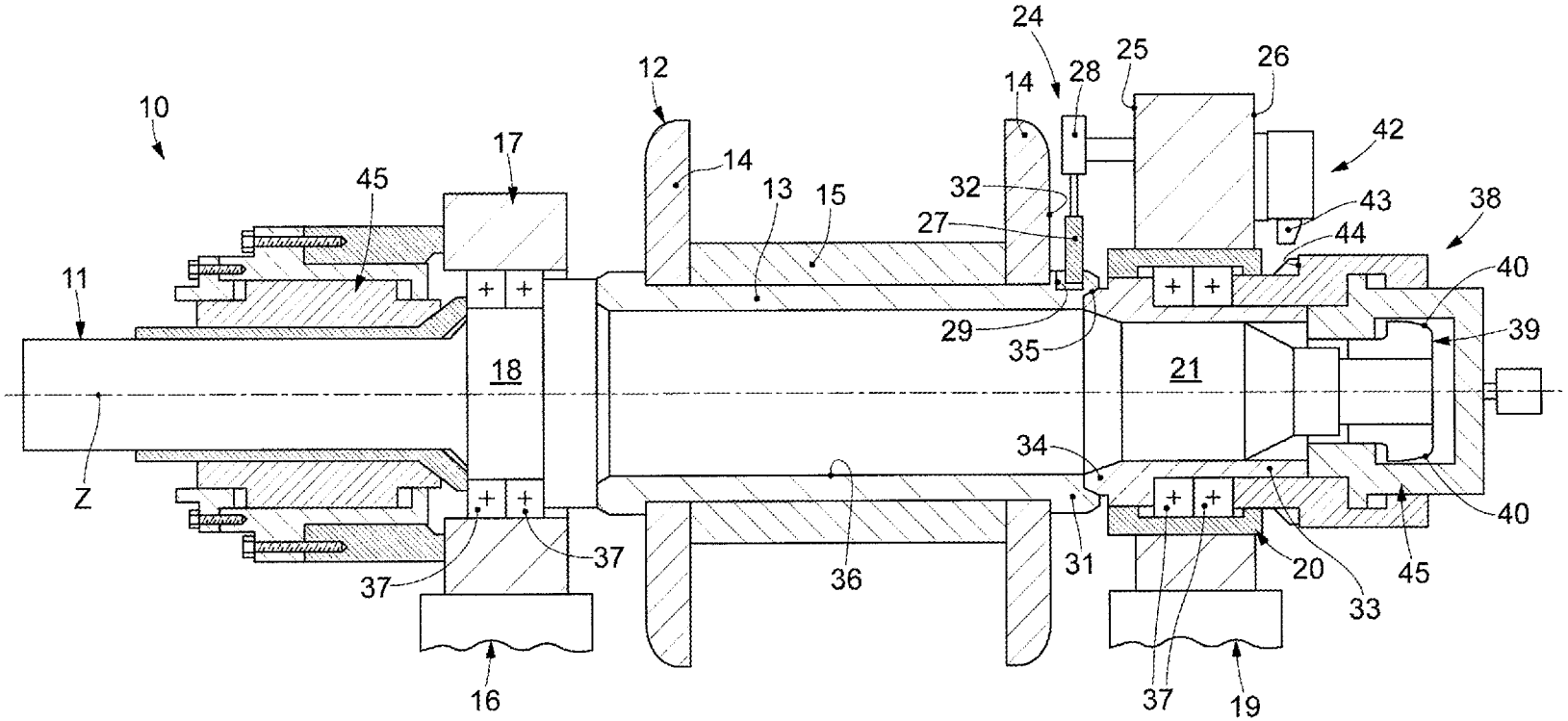
FIG. 2 is a schematic section view of a part of the straightening apparatus in FIG. 1.

The gripping edge 31 can be provided with an attachment portion 29 which can be coupled during use with the gripping element 27. The attachment portion 29 can be defined by a radial seating made in the gripping edge 31, as shown in FIG. 2, or can be defined by a circumferential hollow provided on the gripping edge 31 itself.

In accordance with possible solutions, the gripping edge 31 is distanced, in a direction parallel to the axis of rotation Z, with respect to one of the straightening rings 14. In particular, between the gripping edge 31 and one of the straightening rings 14 there is an interspace 32, for example of an annular shape, in which, during use, the gripping means 24 are at least partly positioned in their active condition.

In accordance with possible solutions, the gripping edge 31 can be made on the bushing 13 of the straightening roll 12.

The presence of a gripping edge 31, provided on the bushing 13 of the straightening roll 12, allows to use the same gripping means 24 to take and hold straightening rolls 12 of different sizes, or having different sizes of the straightening rings 14.

Depending on the sizes of the metal product to be processed, in fact, it is possible to install on the bushing 13 straightening rings 14 of different sizes and intended to process the specific product.

The gripping edge 31 can be made as a separate component and subsequently connected to the bushing 13 of the straightening roll 12.

According to variant embodiments, not shown, the gripping means 24 can act directly on the straightening rings 14 to exert the gripping and holding action of the respective straightening rolls 12.

According to possible solutions, not shown, it is possible to provide gripping means 24 installed in diametrically opposite positions and suitable to completely support and hold the straightening rolls 12 during their movement.

In accordance with a possible solution, shown by way of example in FIG. 2, the second support member 20 can comprise a support bushing 33 having a tubular shape and inserted axially, during use, at least on the second end 21 of the rotation shaft 11.

The support bushing 33, in turn, is associated with the second structure 19 to allow the rotation shaft 11 to be supported.

The support bushing 33 is provided with a support end 34 which is installed protruding with respect to the second structure 19 and, during use, toward the straightening roll 12.

The support end 34 can be defined by a circumferential edge of the support bushing 33 itself.

The straightening roll 12, in this specific case its bushing 13, can be provided, at one end of its axial cavity 36, with a circumferential hollow in which the support end 34 of the support bushing 33 is positioned during use.

The gripping means 24 are configured to maintain the straightening roll 12 inserted with its circumferential hollow 35 in the support end 34. This allows to support the straightening roll on the second structure 19 even when it is not inserted in the rotation shaft 11.

In accordance with possible solutions, the second support member 20 can comprise bearings 37, for example radial, axial or mixed bearings, configured to support the rotation shaft 11 during its rotation.

The bearings 37 can be installed on the support bushing 33.

According to possible solutions of the present invention, at least one clamping unit 38 is associated with the second structure 19, in this specific case a plurality of clamping units 38 configured to selectively clamp-unclamp the respective rotation shaft 11 with respect to the second structure 19.

The clamping unit 38 can be, for example, of the type shown and described in the patent EP-B-3.081.316, also in the name of the present Applicant.

By way of example only, it can be provided that the second end 21 of the rotation shaft 11 has a shaped end portion 39 which can be selectively coupled with the clamping unit 38 in order to connect the rotation shaft 11 integrally with the second structure 19.

The shaped end portion 39 can be provided with one or more teeth 40 protruding radially with respect to the axis of rotation Z of the rotation shaft 11.

The clamping unit 38 can be provided with a suitably shaped coupling cavity 41 so as to define a bayonet coupling with the shaped end portion 39 of the rotation shaft 11.

In particular, by suitably controlling the rotation of the rotation shaft 11 with respect to that of the clamping unit 38, it is possible to constrain or release the rotation shaft 11 with respect to the second structure 19. In the released condition of the clamping unit 38 it is possible to axially move the second structure 19, in a direction parallel to the axis of rotation Z, leaving the rotation shaft 11 supported cantilevered on the first structure 16. The shaped end portion 39 can, in fact, slide in the coupling cavity 41.

In the constraint condition of the clamping unit 38, the teeth 40 of the shaped end portion 39 are positioned in an interfering condition with the coupling cavity 41, and axial movement is prevented.

The clamping unit 38, in normal use, can be rotated together with the rotation shaft 11.

In accordance with possible solutions, an interference device 42 can be associated with the second structure 19, and is configured to prevent the rotation of the clamping unit 38 with the rotation shaft 11, for example when it is required to release the clamping unit 38 from the shaped end portion 39.

In accordance with possible solutions, the interference device 42 can be installed on the second structure 19.

In some solutions, the gripping means 24 can also perform the function of an interference device 42, so that when the gripping means 24 assume the active or inactive condition, the rotation of the clamping unit 38 is constrained or released.

By way of example only, the interference device 42 can comprise a clamping tooth 43 which can be moved to selectively couple with one or more interference seatings 44 provided in the clamping unit 38.

The interference device 42 can be installed at the side of the second surface 26 of the second structure 19.

A compression unit 45 can also be associated with the second support member 20, and is configured to selectively exert a desired axial compression, toward the straightening roll 12, in order to compact the second support member 20 against the latter and prevent the presence of axial play between the parts.

The compression unit 45 can be associated and/or cooperate with the clamping unit 38 described above.

The first support member 17 can also comprise bearings 37, for example similar to those described above and suitable to allow the rotation of the rotation shaft 11 around the axis of rotation Z.

A compression unit 46 can be associated with the first support member 17, for example similar to the compression unit 45 described above and configured to compress the first support member 17 against the rotation shaft 11.

A drive unit, not shown in the drawings, is connected to the rotation shaft 11, on the side of the first end 18, and is provided to selectively make the rotation shaft 11 rotate around its axis of rotation Z.

In accordance with possible solutions of the present invention (FIG. 1), the straightening apparatus 10 comprises at least one support slider 47, in this specific case two support sliders 47, each provided to support a group of straightening rolls 12 to be installed on the rotation shafts 11.

The support slider 47 can be provided with support elements 48 on which the straightening rolls 12 can be inserted and supported, with their axial cavities 36.

In accordance with possible solutions, the support slider 47 can be mobile along sliding guides 49 installed transversely to the guide elements 23. In particular, it can be provided that the sliding guides 49 are installed in the space comprised between the first structure 16 and the second structure 19, when the latter is in a position distanced from the first structure 16.

With reference to FIGS. 3-12 we will now describe a possible method to replace the straightening rolls 12.

Figure 3:
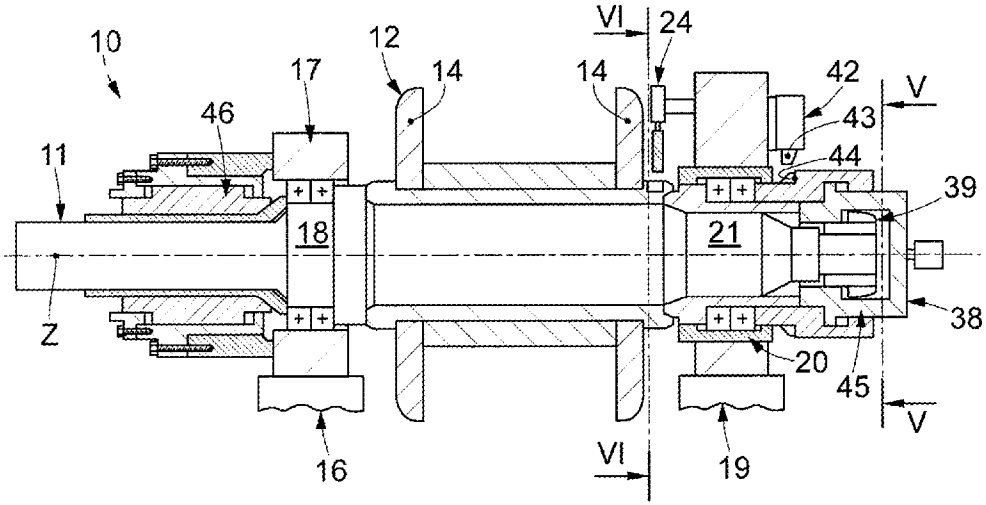
FIG. 3 is a schematic section view of a part of the straightening apparatus in a first operating condition.
Figure 4:
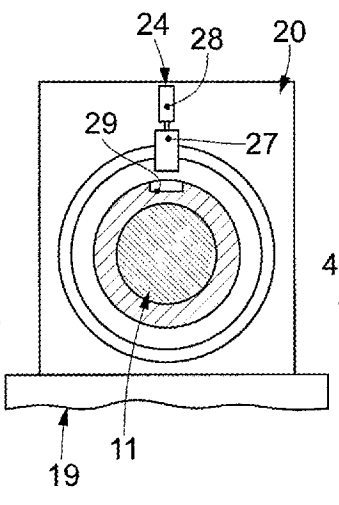
FIGS. 4 and 5 are section views are the section lines VI-VI and, respectively V-V in FIG. 3.
Figure 5:
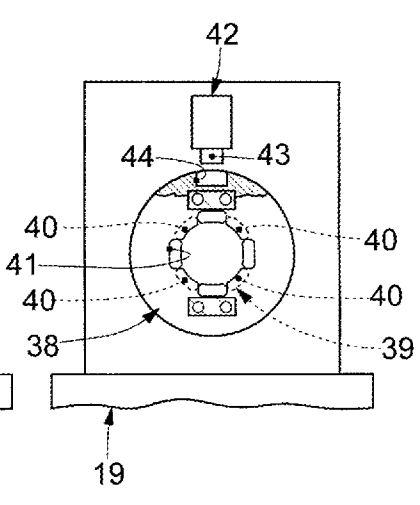

In particular, FIG. 3 shows an operating mode of the straightening rolls 12, in which the compression units 45 and 46 maintain the respective support members 17 and 20 in compression toward the straightening roll 12 and the rotation shaft 11, the clamping unit 38 constrains the axial position of the rotation shaft 11 with respect to the second structure 19 and the gripping means 24 are in their inactive condition.

Figure 6:
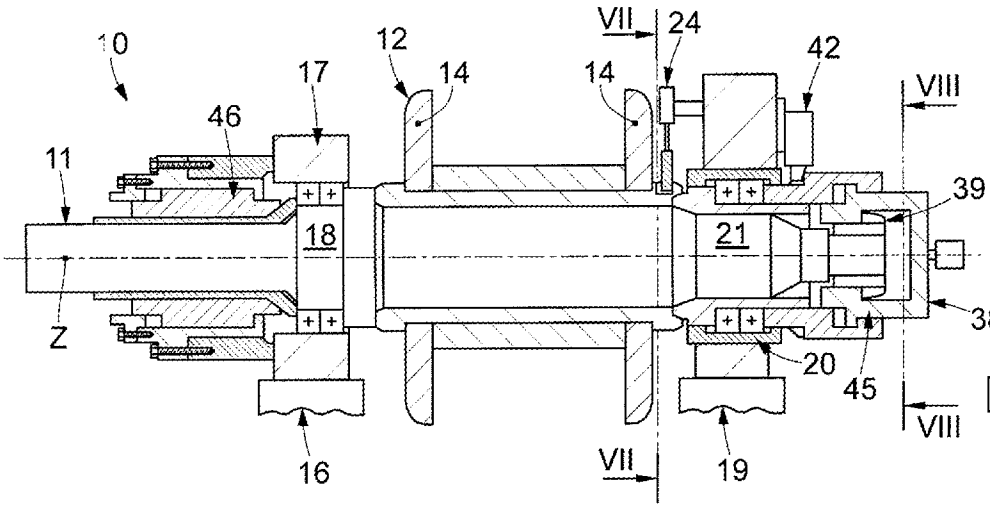
FIG. 6 is a schematic section view of a part of the straightening apparatus in a second operating condition.
Figure 7:
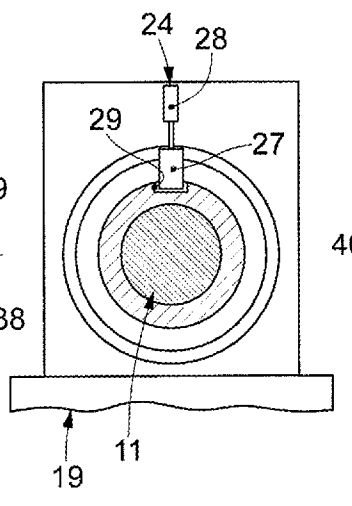
FIGS. 7 and 8 are section views along the section limes VII-VII and, respectively VIII-VIII in FIG. 6.

When replacement of the straightening rolls 12 is required, the compression units 45 and 46 are deactivated (FIG. 6). It is then provided to activate the gripping means 24 (FIG. 7) and the interference devices 42 (FIG. 8), which take and hold the straightening rolls 12 against the second structure 19 and respectively prevent the rotation of the clamping unit 38.

Figure 8:
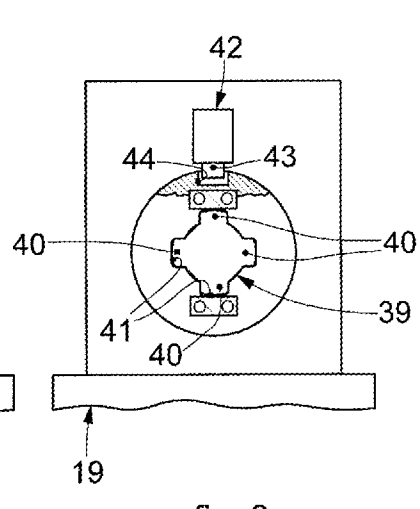
Figure 9:
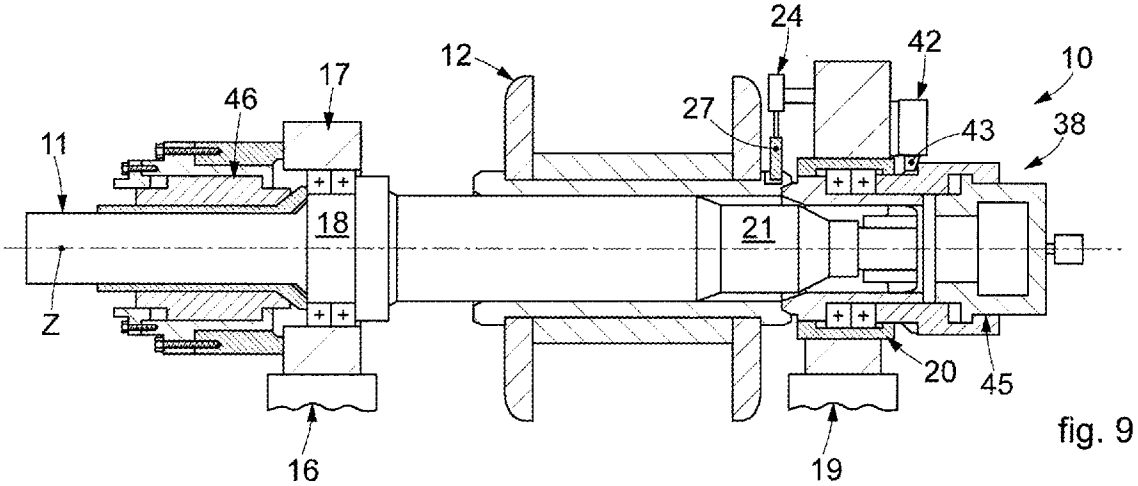
FIGS. 9-12 are schematic section views of part of the straightening apparatus in respective operating conditions.
Figure 10:
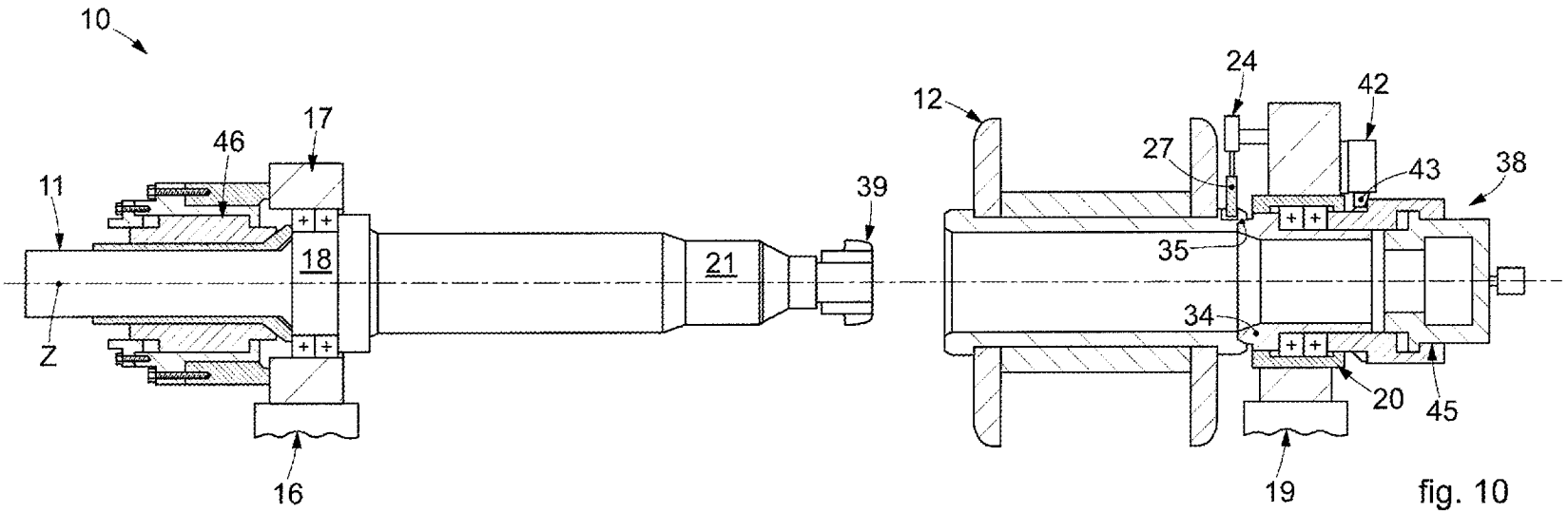

In this condition, the controlled rotation of the rotation shaft 11 is commanded, to align the teeth 40 of the shaped end portion 39 to the coupling cavity 41 and to allow its axial extraction (FIG. 8).

In this condition it is possible to command the movement of the second structure 19 by means of the movement member 22, moving it away from the first structure 16. This allows to axially remove the straightening rolls 12 (FIG. 9) in an axial direction along the axis of rotation Z.

When the straightening rolls 12 are completely removed from the rotation shafts 11 (FIG. 10), the straightening rolls 12 themselves are supported on the second structure 19 by the action of the gripping means 24 and possibly by the cooperation of the support end 34 of the support bushing 33 with the circumferential hollow 35 of the straightening roll 12.

Figure 11:
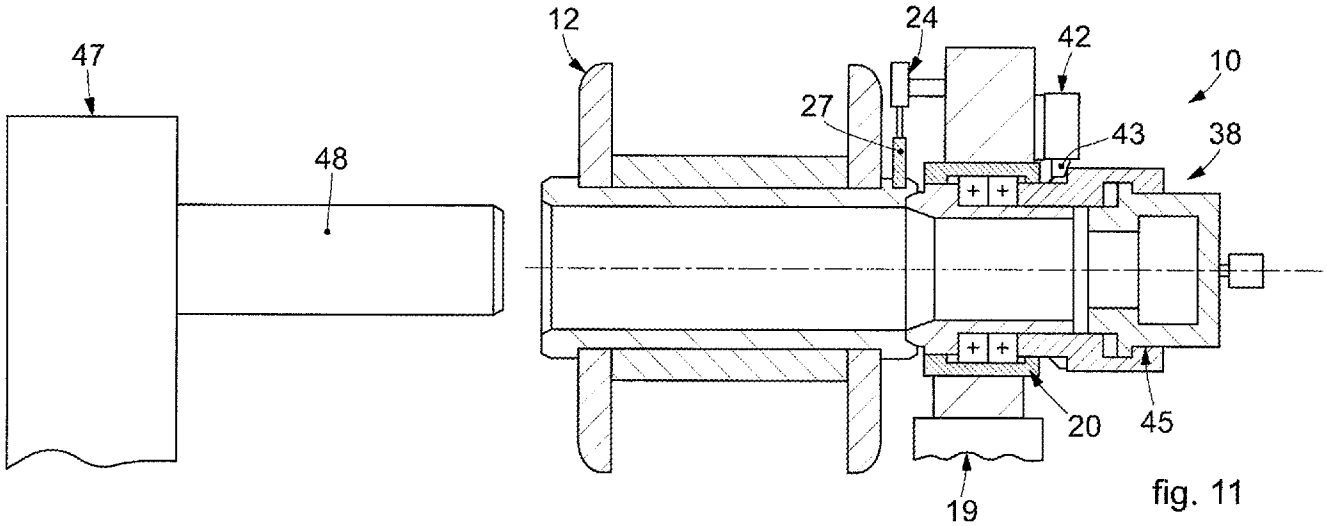
Figure 12:
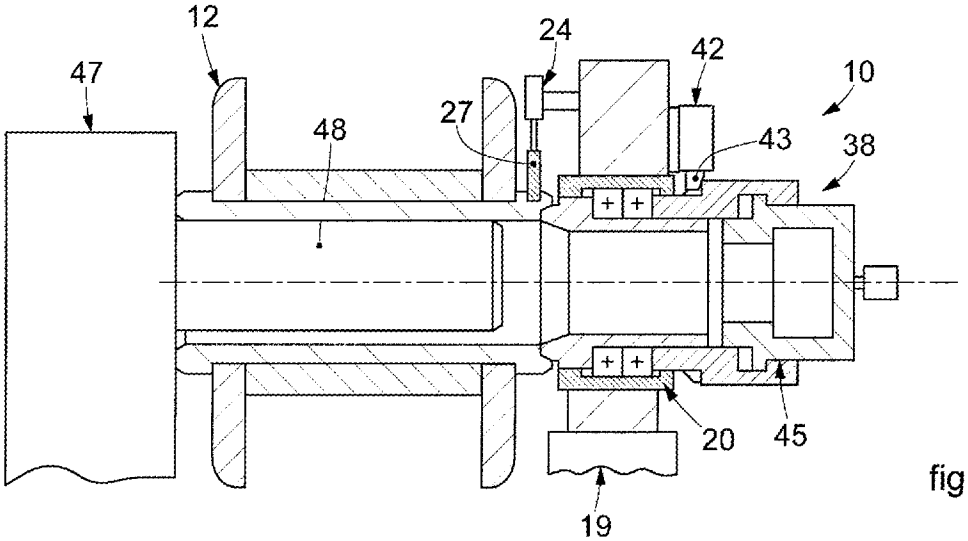

The second structure 19 is distanced from the second end 21 of the rotation shaft 11 by a distance sufficient to allow the insertion, between them, of the support slider 47 without the straightening rolls 12 (FIG. 11).

In this condition, the second structure 19 is again moved toward the first structure 16 to position the straightening rolls 12 on the support elements 48 of the support slider 47.

In this condition, the gripping means 24 can be taken into their inactive condition, and the second structure 19 can be moved away, leaving the straightening rolls 12 on the support slider 47. The support slider 47 with the straightening rolls 12 to be replaced can be discharged from the zone comprised between the first structure 16 and the second structure 19 to leave space to a support slider 47 with the straightening rolls 12 to be installed on the rotation shaft 11.

When the new straightening rolls 12 face the second structure 19, the latter is moved toward the new support slider 47 and the gripping means 24 are driven to take and hold the new straightening rolls 12 against the second structure 19.

The second structure 19 is moved away from the support slider 47, taking the straightening rolls 12 with it. The support slider 47 which supported the new straightening rolls 12 can be taken out of the space comprised between the first structure 16 and the second structure 19, leaving the straightening rolls 12 supported on the second structure 19.

The second structure 19 with the new straightening rolls 12 can be moved toward the first structure 16 to allow to insert the straightening rolls 12 on the rotation shafts 11 and to selectively clamp them.

It is clear that modifications and/or additions of parts may be made to the apparatus 10 for straightening metal products and the method to replace at least one straightening roll 12 as described heretofore, without departing from the field and scope of the present invention.

It is also clear that, although the present invention has been described with reference to some specific examples, a person of skill in the art shall certainly be able to achieve many other equivalent forms of apparatus 10 for straightening metal products and the method to replace at least one straightening roll 12, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. An apparatus for straightening metal products comprising:

a rotation shaft on which a straightening roll is installed in a selectively removable manner;

a first structure provided with at least a first support member configured to hold and support a first end of the rotation shaft;

a second structure provided with at least a second support member configured to selectively support and hold a second end, opposite the first end, of the rotation shaft, wherein said second support member comprises a tubular support bushing inserted axially at least on the second end of the rotation shaft, in that said tubular support bushing is provided with a support end installed protruding with respect to the second structure and toward the straightening roll, and in that the straightening roll is provided, at one end of an axial cavity thereof, with a circumferential hollow in which said support end of said tubular support bushing is positioned;

a movement member configured to move the second structure toward/away from the first structure and to allow the installation or removal of the straightening roll from the rotation shaft, wherein said second structure is provided with gripping means, able to be selectively activated to take and hold the straightening roll on the second structure at least during the movement of the second structure.

2. The apparatus as in claim 1, wherein said second structure is provided with a first surface facing, during use, toward the first structure and with a second surface, opposite said first surface, and in that said gripping means are at least partly installed in the space comprised between said first surface and the straightening roll.

3. The apparatus as in claim 1, wherein said gripping means comprise a gripping element configured to attach at least one portion of the straightening roll to the second structure, and an actuation device configured to take the gripping element to an active attachment condition of the straightening roll and an inactive condition of non-interference with the straightening roll.

4. The apparatus as in claim 1, wherein the straightening roll is provided, at one end, with a gripping edge, and in that said gripping edge, during use, is directly facing said second structure, and said gripping means are able to be selectively coupled with said gripping edge in order to take and hold the straightening roll on the second structure.

5. The apparatus as in claim 4, wherein the straightening roll comprises a bushing having an axial cavity able to be inserted axially on the rotation shaft, and two straightening rings attached solidly to the ends of said bushing, and in that between said gripping edge and one of the straightening rings there is an interspace in which said gripping means are at least partly positioned.

6. The apparatus as in claim 1, wherein said gripping means are configured to keep the straightening roll inserted with its circumferential hollow in said support end.

7. A method to replace a straightening roll installed in a selectively removable manner on a rotation shaft, said method providing:

to hold and support a first end of the rotation shaft on a first support member of a first structure, to selectively support and hold a second end, opposite said first end, of the rotation shaft on a second support member of a second structure, wherein said second support member comprises a tubular support bushing inserted axially at least on the second end of the rotation shaft, in that said tubular support bushing is provided with a support end installed protruding with respect to the second structure and toward the straightening roll, and in that the straightening roll is provided, at one end of an axial cavity thereof, with a circumferential hollow in which said support end of said tubular support bushing is positioned, to move said second structure, with a movement member, relative to said first structure, wherein at least during the movement of said second structure relative to said first structure, gripping means take and hold the straightening roll on said second structure to allow, during the removal, the axial removal of the straightening roll from the rotation shaft or, during installation, the axial insertion of the straightening roll on the rotation shaft.

8. The method as in claim 7, wherein when the installation of said straightening roll on the rotation shaft is required:

a support slider with the straightening roll is positioned between said first structure and said second structure, disposing said straightening roll facing said second structure, said gripping means take and hold said straightening roll, said support slider moves outside the space comprised between said first structure and said second structure, leaving said straightening roll on said second structure, and said second structure is moved toward said first structure to insert said straightening roll on the rotation shaft.

9. The method as in claim 7, wherein when the removal of the straightening roll from the rotation shaft is required:

said gripping means are driven to take and hold the straightening roll on said second structure, said second structure is moved away from said first structure, removing the straightening roll from the rotation shaft, a support slider is positioned between said first structure and said second structure to receive the straightening roll supported by said second structure, said gripping means are deactivated to position the straightening roll on said support slider.

* * * * *